US005964665A

United States Patent [19]

Uemura

[11] Patent Number: 5,964,665

[45] Date of Patent: Oct. 12, 1999

[54] VEHICLE PLAYING APPARATUS

[75] Inventor: Hiroshi Uemura, Tokyo, Japan

[73] Assignee: Sega Enterprises, Ltd., Tokyo, Japan

[21] Appl. No.: 09/011,978

[22] PCT Filed: Jun. 19, 1997

[86] PCT No.: PCT/JP97/02113

§ 371 Date: Jul. 15, 1998

§ 102(e) Date: Jul. 15, 1998

[87] PCT Pub. No.: WO98/01200

PCT Pub. Date: Jan. 15, 1998

[30] Foreign Application Priority Data

Jul. 3, 1996 [JP] Japan ..... 8-173557

[51] Int. Cl.[6] ..... A63G 1/28

[52] U.S. Cl. ..... 472/45; 472/43

[58] Field of Search ..... 472/43, 44, 45, 472/46, 47, 59, 60, 135

[56] References Cited

FOREIGN PATENT DOCUMENTS 1-31260 9/1989 Japan .
5-10119 2/1993 Japan .
7-19755 4/1995 Japan .
3018425 9/1995 Japan .
7-265549 10/1995 Japan .

*Primary Examiner*—Kien T. Nguyen
*Attorney, Agent, or Firm*—Dickstein Shapiro Morin & Oshinsky, LLP

[57] ABSTRACT

A vehicle playing apparatus on which a player himself or herself operates a simulation vehicle. The apparatus comprises a vehicle moving variably on which a player rides, driving mechanism 33, 70 for driving the vehicle detection member 25, 26, 35 for detecting a state of the vehicle, operation member 42, 46 provided on the vehicle, and controller 80 for controlling the drive mechanism based on a detection signal inputted from the detection member and an operation signal inputted from the operation member. The controller judges the state of the vehicle in accordance with the detection signal, indication and timing of the operation signal in view of the state, of vehicle to output an instruction signal to the drive mechanism.

25 Claims, 14 Drawing Sheets

VEHICLE PLAYING APPARATUS

TECHNICAL FIELD

The present invention relates to a vehicle playing apparatus having a simulated vehicle on which a player rides to operate it.

BACKGROUND ART

Some vehicle playing apparatuses of this kind simulate an actual vehicle such as a motorcar, motorcycle or aeroplane. The simulated vehicle does not run actually, but moves in accordance with an operation instruction of the player as far as it can afford surplus move.

The coffee-cup playing apparatus in an amusement park or the like has some small disks rotatively supported on a large rotary disk. On the small disk are disposed a plurality of vehicles shaped like coffee cups so as to rotate about its own axis and a player riding on the vehicle can rotate the vehicle by hand operation.

The player on the vehicle (coffee cup) moves along a complicated orbiting path produced by combination of two revolutions due to rotations of the large and small disks and rotation of the coffee cup. The speed changes moment by moment. Meanwhile the coffee cup is accelerated or decelerated by controlling its rotation by hand operation.

In the former example simulating an actual vehicle, the simulated vehicle moves in accordance with the operation instruction always regardless of state of movement of the vehicle so far as it can afford surplus move, and timing of operation instruction has no effect on the movement. Therefore, it is impossible to enjoy a technical skill such as deciding timing of operation judging from the state of movement of the vehicle.

In the latter example of the coffee-cup playing apparatus, since the coffee cup is rotated by hand operation while the coffee cup makes a complicated move, at a time point, speeds are added to accelerate and at another time point, speeds are offset to decelerate. However, it is impossible to decide timing of operation previously judging from the state of movement of the vehicle.

DISCLOSURE OF INVENTION

The present invention has been accomplished in view of the foregoing and it is an object of the invention to provide a vehicle playing apparatus by which players can enjoy and contest a technical skill such as deciding indication and timing of operation judging from a state of movement of a vehicle.

In order to attain the above object, the present invention provides a vehicle playing apparatus comprising a vehicle moving variably on which a player rides; drive means for driving the vehicle; detection means for detecting a state of the vehicle; operation means provided on the vehicle; and control means for controlling the drive means based on a detection signal inputted from the detection means and an operation signal inputted from the operation means. The above-mentioned control means judges the state of the vehicle in accordance with the detection signal and judges indication and timing of the operation signal in view of the state of the vehicle to output an instruction signal to the drive means. Therefore, movements of the vehicle are different in accordance with instruction of operation by the player and timing thereof.

Accordingly, the player has to judge the state of the vehicle through the senses and give a pertinent instruction of operation timely and is required sensory skill so that the player can enjoy pleasure of progress and pleasure of contesting technical skill.

According to the above-mentioned vehicle playing apparatus wherein the vehicle moves variably along an orbiting path and the orbiting path is divided into an orbiting range in which the vehicle is automatically moved and another orbiting range in which the vehicle behaves different moves in accordance with operation of the player, even a beginner can enjoy going through the variable movement in the former orbiting range, and an expert can enjoy the play in the latter range.

According to the vehicle playing apparatus wherein the control means outputs an instruction signal to the drive means so as to encourage present movement of the vehicle when the indication and timing of the operation signal are judged pertinent in view of the state of the vehicle, when the player judges the state of the vehicle through the senses and gives a pertinent indication of operation timely, the movement of the vehicle at present is encouraged to increase its velocity and width, so that the player can go through more exciting movement.

According to the vehicle playing apparatus wherein the vehicle moves variably along a plurality of orbiting paths, the driving means, detection means and operation means are provided for each of the orbiting paths respectively, and the control means outputs instruction signals for each of the orbiting paths to corresponding driving means, movement of the vehicle is complicated so that the player can go through more exciting movement and is required a high level of skill, and the apparatus can be made more interesting.

If a sum of velocities of variable moves on the plurality of the orbiting paths is always kept below a predetermined value, safety is ensured.

According to the vehicle playing apparatus wherein the vehicle moves along two orbiting path, a sum of a velocity of variable move on an orbiting path and a velocity of variable move on another orbiting path is constant, and when the velocity on an orbiting path is maximum, the velocity on another orbiting path is minimum, the player on the vehicle can go through a pertinent velocity always to enjoy an exciting play.

According to the vehicle playing apparatus wherein a plurality of operation means are provided for an orbiting path of the vehicle, and the control means decides the instruction signal to be outputted to the drive means based on a plurality of operation signals from the operation means, a plurality of players can ride on one vehicle to operate separately.

If the control means selects a most pertinent operation signal among the operation signals in view of the state of the vehicle for deciding the instruction signal, the vehicle is moved by an expert most skillful in the operation so that another player riding on the vehicle together with the expert also can go through the same exciting experience.

If the control means calculates a mean value of the operation signals for deciding the instruction signal, when operations of the players on the vehicle are pertinent on an average, the vehicle moves excitingly to afford more interesting experience. Namely, whether or not operations of players on the same board coincide with each other influences movement of the vehicle.

Further, the present invention provides a vehicle playing apparatus comprising: a vehicle moving variably on which a player rides; drive means for moving the vehicle; operation signal output means for outputting an operation signal in response to an operation of the player; detection means for detecting a state of the vehicle; and control means for controlling the drive means to change movement of the vehicle in response to the operation signal only when it is judged that the vehicle is in a predetermined state.

In this apparatus, the player has to judge state of the vehicle and decide an operation timing himself and is required a technical skill so that his intention to the play is roused and the interest is continued.

If the control means controls the drive means in accordance with a program automatically when the state of the vehicle detected by the detection means is different from a predetermined state, even a beginner having no skill can enjoy going through movement of the vehicle.

According to the vehicle playing apparatus wherein the vehicle is a board hung from a pivotal shaft so as to rock freely moving right and left along a pendulum rocking orbiting path, a non-experienced man can simulatively experience an actual half-pipe game in which a player riding on a skateboard or a snow-board runs along an inner surface of a half cylinder, as a road surface for running right and left like a pendulum and revolves at a position separated from the road surface with a large rocking angle to contest a technical skill.

If the driving means comprises a rotary friction wheel coming into contact with an arcuate lower surface of the board to rock the board, rocking of the board can be controlled when the friction wheel contacts with the lower surface of the board and in other case the board carries out an natural pendulum motion so that a movement of the board very similar to that of the actual half-pipe game can be realized.

If operation means to be operated by feet of the player on the board is provided, the player can have a simulative experience as if he were on an actual skateboard.

If the operation means comprises a pair of step plates provided on an upper surface of the board for placing respective feet of the player and pressure sensors fitted to the respective step plates for detecting stepping forces of the feet, and detection signal of the pressure sensor is used as the operation signal, the player can operate the board by shifting his own weight so as to give different stepping forces by the right and left feet in the same manner as in case of the actual skateboard.

If the control means outputs an instruction signal to the drive means so as to encourage present rocking of the vehicle when indications and timings of both operation signals from a pair of the step plates are judged pertinent in view of rocking state of the vehicle, operating manner for the board becomes almost the same as that for the actual skateboard so that a simulative experience near the practice more can be obtained and as the operation is more pertinent to encourage the rocking, the player can experience more exciting move.

According to the vehicle playing apparatus wherein the operation means comprises plural pairs of step plates provided on an upper surface of the board on which respective feet of a plurality of players are placed and pressure sensors fitted to the step plates to detect stepping forces of right and left feet, and a detection signal from the pressure sensor is used as the operation signal, a plurality of players can enjoy on one board.

According to the vehicle playing apparatus wherein the control means selects an operation signal from signals of a pair of step plates which is judged that indication and timing are most pertinent in view of rocking state of the vehicle and outputs an instruction signal to the drive means based on the selected signal so as to encourage present rocking of the vehicle, since a most pertinent operation among operations by a plurality of players on the same board is selected, the board is moved by an expert most skillful in the operation so that another player riding on the same board together with the expert also can go through the same exciting experience.

According to the vehicle playing apparatus wherein the vehicle is a board hung from a pivotal shaft for rocking, capable of revolving about its own central vertical axis, having a rocking orbiting path directed right and left and a revolving orbiting path round the vertical axis; rocking drive means, rocking detection means and rocking operation means corresponding to the rocking orbiting path are provided; revolving drive means, revolving detection means and revolving operation means corresponding to the revolving orbiting path are provided; and the control means outputs respective instruction signals for the orbiting paths to corresponding drive means, the board can be revolved as well as rocked in the same manner as the board of the actual half-pipe game.

According to the vehicle playing apparatus wherein a slanting plate supporting a pair of step plates is pivoted on an upper surface of the board so as to slant; the rocking operation means is constituted by the step plates and pressure sensors fitted to the step plates, detection signal of the pressure sensor being used as the rocking operation signal; the revolving operation means is constituted by the slanting plate and slanting sensors fitted to the slanting plate, detection signal of the slanting sensor being used as the revolving operation signal, the player can carry out the revolving control of the board by shifting his own weight front and rear and the rocking control of the board by shifting his own weight right and left, placing his right and left feet on the step plates respectively.

According to the vehicle playing apparatus wherein the control means outputs an instruction signal to the rocking drive means so as to encourage present rocking of the board when indication and timing of the rocking operation signal are judged pertinent in view of rocking state of the board, and outputs an instruction signal to the revolving drive means so as to revolve the board when indication and timing of the revolving operation signal is judged pertinent in view of rocking state of the board, if the rocking operation of the player is pertinent, rocking velocity and rocking angle of the board become large to give an exciting experience, in the same time, if the revolving operation of the player is pertinent, the board can be revolved by several times at a high velocity so that the player can enjoy a more interesting play.

If the control means judges that timing of the revolving operation signal is more pertinent and outputs an instruction signal to the revolving drive means so as to revolve the board faster as rocking velocity of the board is smaller, the board can be revolved faster when the board is separated from the road surface and the rocking velocity is smaller, in the same manner as in case of the actual half-pipe game.

According to the vehicle playing apparatus wherein a slanting plate supporting pairs of step plate is pivoted on an upper surface of the board so as to slant, pairs of pressure sensors fitted to respective the step plates for outputting rocking operation signals as the rocking operation means, and the control means selects an operation signal from the rocking operation signals which is judged that indication and timing are most pertinent in view of rocking state of the board and outputs an instruction signal to the rocking drive means based on the selected signal so as to encourage present rocking of the board, a plurality of players can ride on one board to enjoy the operation at the same time, thereby the operation of an expert takes precedence so that another player riding together can have the same exciting experience as the expert. However, since the revolving operation is carried out by slanting the slanting plate which is operated by a plurality of players, the board does not revolve unless all players coincide.

THE BEST MODE FOR CARRYING OUT THE INVENTION

Hereinafter, a preferred embodiment of the present invention will be described with reference to FIGS. 1 to 16.

Figure 1:
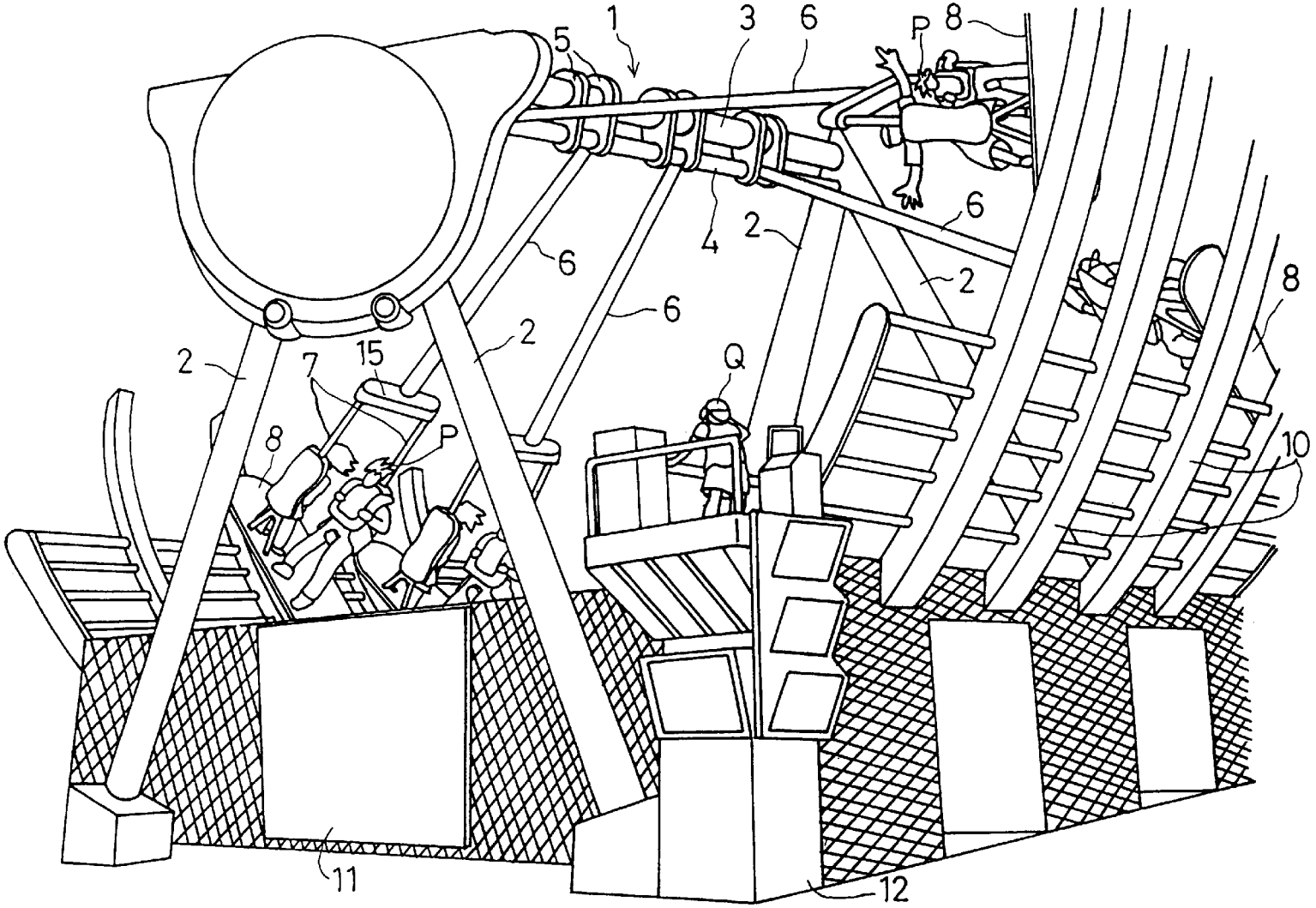
FIG. 1 is an external view of a half-pipe game playing apparatus according to a preferred embodiment of the present invention.

FIG. 1 is an external view of a half-pipe game playing apparatus 1 according to the preferred embodiment. Two triangles each having two struts elected diagonally for forming an upper portion at which the struts are connected to each other are provided in front and rear facing each other and a horizontal cross pipe 3 is laid between the above-mentioned upper portions.

A pivotal shaft 4 is laid under the horizontal cross pipe 3 and between the triangles in parallel with the horizontal cross pipe 3. The pivotal shaft 4 is supported from the horizontal cross pipe 3 by some pairs of supporting brackets 5. In the apparatus 1 of FIG. 1, four pairs of supporting brackets 5 are disposed at regular intervals along the horizontal cross pipe 3.

At every pair, a rocking arm 6 is hung between opposite brackets 5 so as to rock freely with a base end pivoted on the pivotal shaft 4. A long board 8 simulating a skateboard or a snow-board is hung from the rocking arm 6 by a pair of revolving arms 7.

Therefore, the board 8 can be rocked about the pivotal shaft 4 right and left like a pendulum. Four such boards 8 are disposed in front and rear and each board 8 can carry one or two players P.

A framework 10 like a half-pipe is constructed along an orbiting path on which the board 8 rocks.

A notice board 11 for guidance is provided in front of the framework 10 and on one side of the notice board 11 is erected an observation stand for a watchman Q.

The player P riding on the board 8 stands turning his back on one of the revolving arms 7 and fasten a safety belt to participate in the play.

On a bottom portion of the framework 10 extending along the orbiting path of the board 8 is disposed a rocking drive mechanism using friction wheels 60 for rocking the board 8.

The board 8 can revolve as well as rock along the framework 10 like a pendulum, therefore the player P on the board 8 can undergo a simulative experience as if he were participating in a actual half-pipe game and playing.

Though two players cannot ride at a time in case of the actual board, two players can ride on the board 8.

Figure 3:
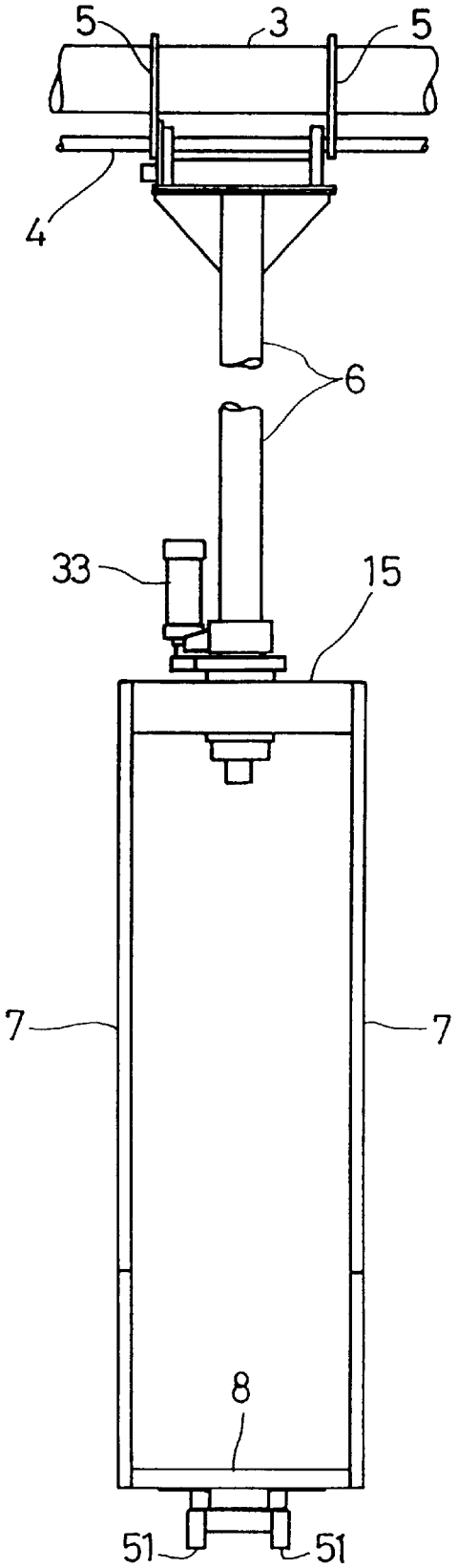
FIG. 3 is a side view showing a hanging construction of a board.

As shown in FIG. 3, the upper end of the rocking arm 6 is pivoted on the pivotal shaft 4 and a pair of revolving arms 7 extends from both ends of a horizontal revolving frame 15 pivotally supported at a lower end of the rocking arm 6.

The board 8 is provided between lower ends of the revolving arms 7. Therefore, the board 8 can revolve about the rocking arm 6 as well as rock right and left about the pivotal shaft 4. Thus the board 8 has two orbiting path, a rocking orbiting path and a revolving orbiting path.

Figure 4:
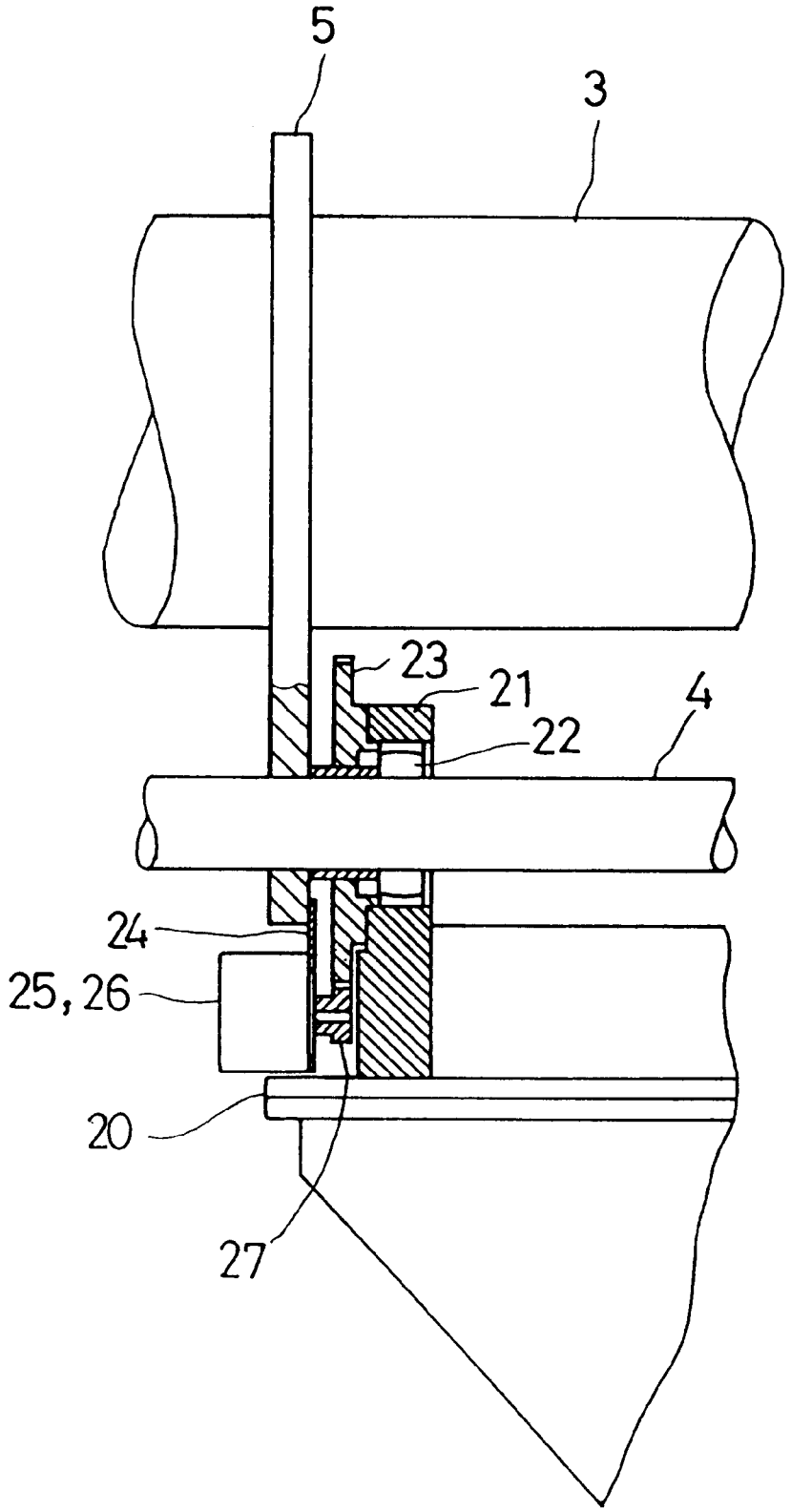
FIG. 4 is a sectional view of an essential part showing a rocking mechanism.

FIG. 4 shows detail of a pivot portion at a base end of the rocking arm 6. A connecting plate 20 extending in front and rear is fixed to the base end of the rocking arm 6 perpendicularly thereto, and a pair of front and rear bearing plates 21 are erected on the connecting plate 20. Each bearing plate 21 is arranged inside of a corresponding supporting bracket 5 and penetrated by the pivotal shaft 4 to be supported through a bearing 22.

Between one of the supporting brackets 5 and a bearing plate 21 corresponding thereto is provided a gear 23 fitted onto the pivotal shaft 4. The gear 23 engages with a gear 27 fitted onto a rotary shaft of a pulse generator 25 and a tachometer generator 26 which are supported by the supporting bracket 5 through a fixing piece 24. Therefore, rocking angle of the board 8 is detected by the pulse generator 25 and rocking angular velocity of the board 8 is detected by the tachometer generator 26.

Figure 5:
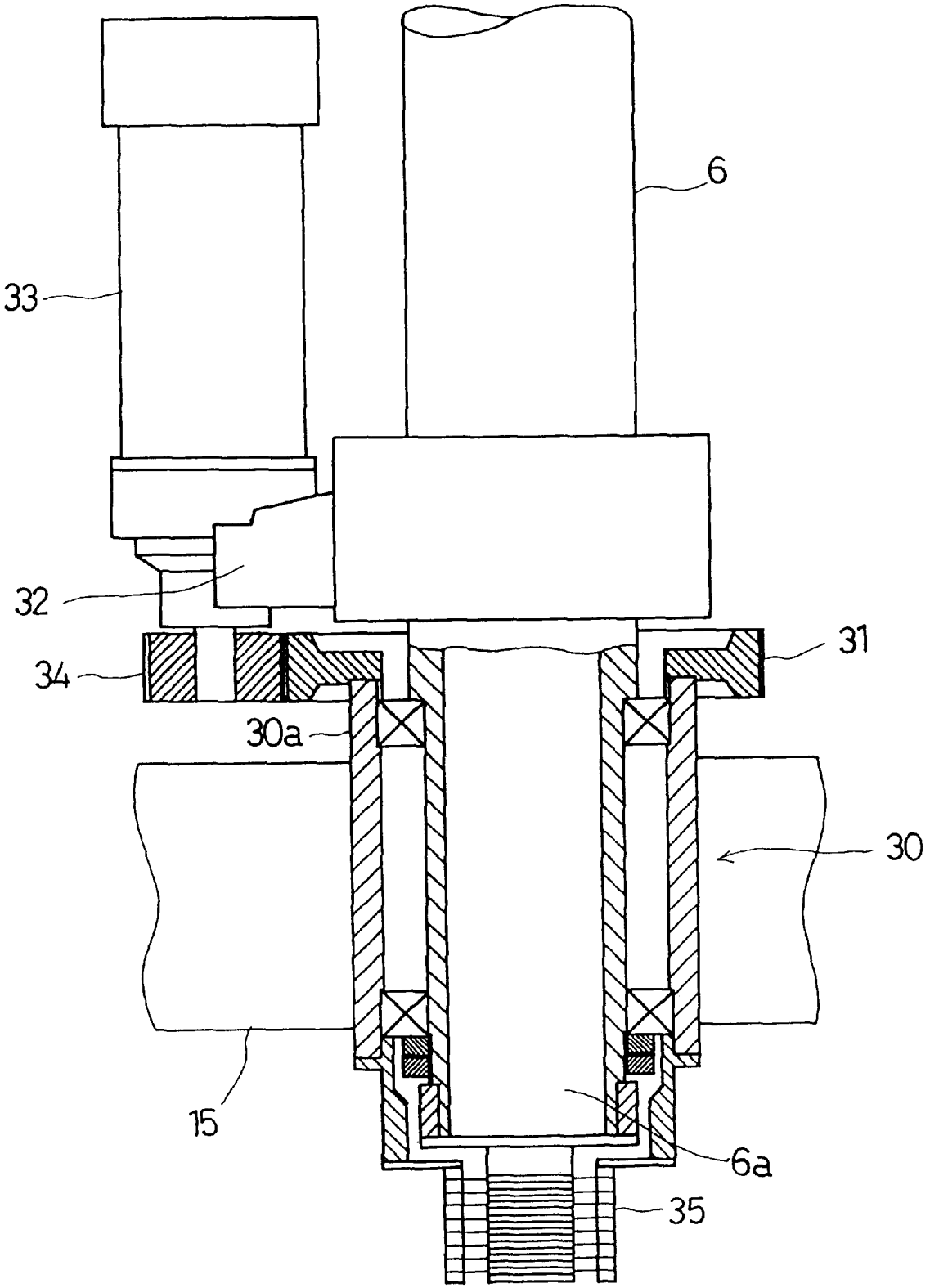
FIG. 5 is a sectional view of an essential part showing a revolving mechanism.

FIG. 5 shows a structure for revolving the horizontal revolving frame 15 at a bottom part of the rocking arm 6. A lower end 6a of the rocking arm 6 is fitted in the middle of the horizontal revolving frame 15 through a bearing 30. A gear 31 fitted on an outer race 30*a* of the bearing 30 engages with a gear 34 fitted on a drive shaft of a revolving servomotor 33 which is attached to the rocking arm 6 by a fixing metal 32. Therefore, the horizontal revolving frame 15 is driven by the revolving servomotor 33 through the gears 34, 31 to revolve about the rocking arm 6. A position sensor 35 is attached between a lower end integral with the rocking arm 6 and a part extending downward from the outer race 30*a* to detect a basic point of revolution of the board 8.

Figure 6:
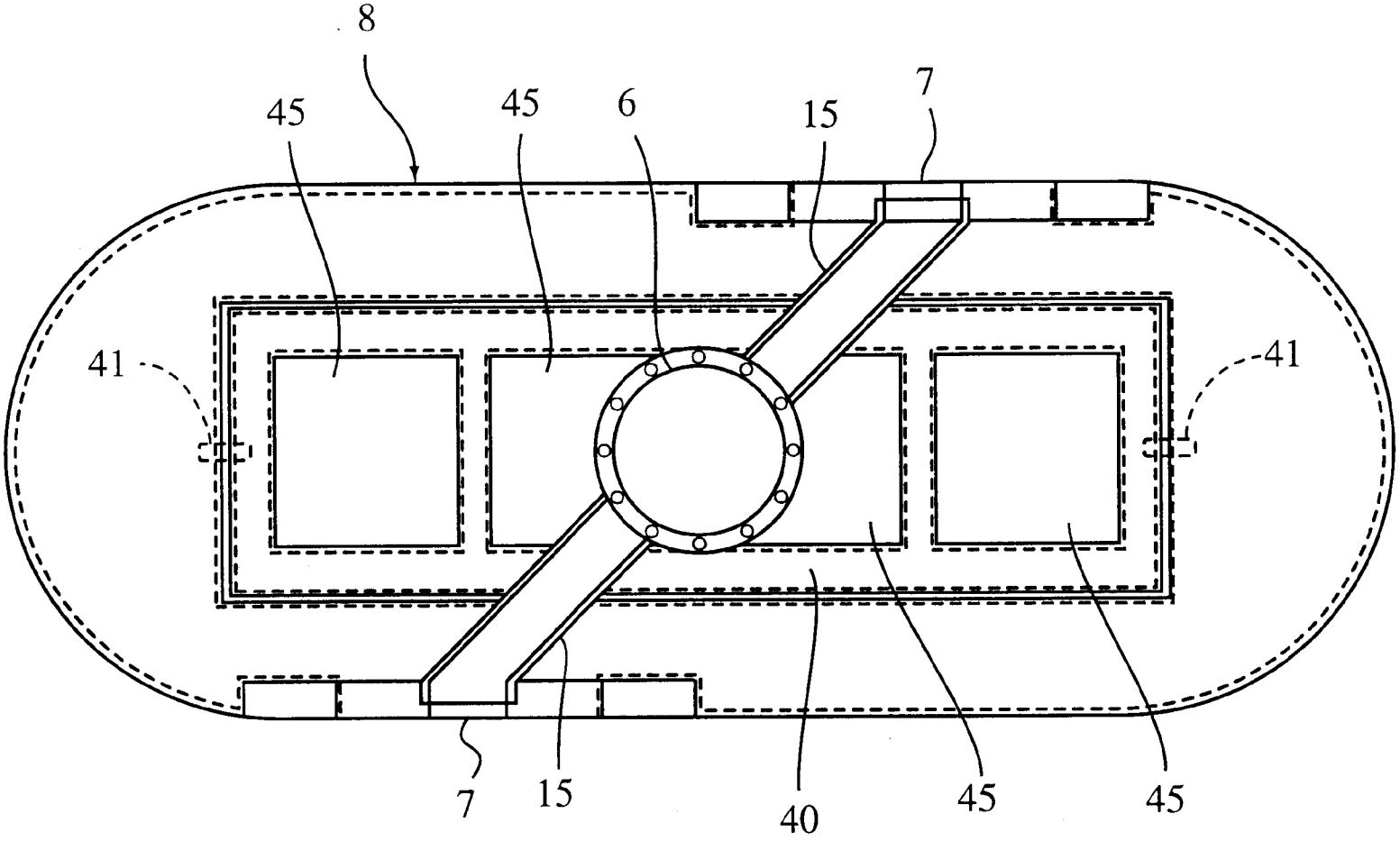
FIG. 6 is a top view of the board including a horizontal revolving frame.

The horizontal revolving frame 15 and the board 8 are connected by a pair of revolving arms 7. As shown in FIG. 6, the horizontal revolving frame 15 is directed obliquely with regard to the lengthwise direction of the board 8 and each revolving arm going down from each end of the horizontal revolving frame 15 forks off into two branches halfway and fixed to a side edge of the board 8. Therefore, fixing positions of two revolving arms 7 to the board 8 are alternated in the lengthwise direction of the board 8.

The board 8 has a rectangular opening at the middle of the upper face and a slanting plate 40 is fitted in the opening with a little clearance. The slanting plate 40 is supported by coaxial pivots 41 at the both ends so as to slant freely about the pivots 41. However, the slanting plate 40 is forced to be maintained horizontal always and slanting angle thereof is limited to be small.

Figure 8:
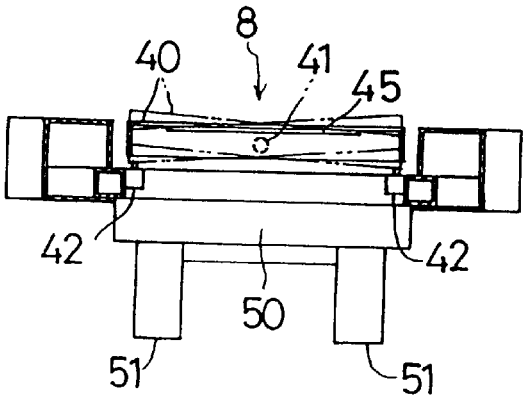
FIG. 8 is a side view showing the board partly in section.

As shown in FIG. 8, limit switches 42, 42 are disposed under respective middles of both lengthwise side edges of the slanting plate 40 so that slanting of the slanting plate 40 can be detected when the plate 40 slants to turn on either limit switch 42.

Figure 7:
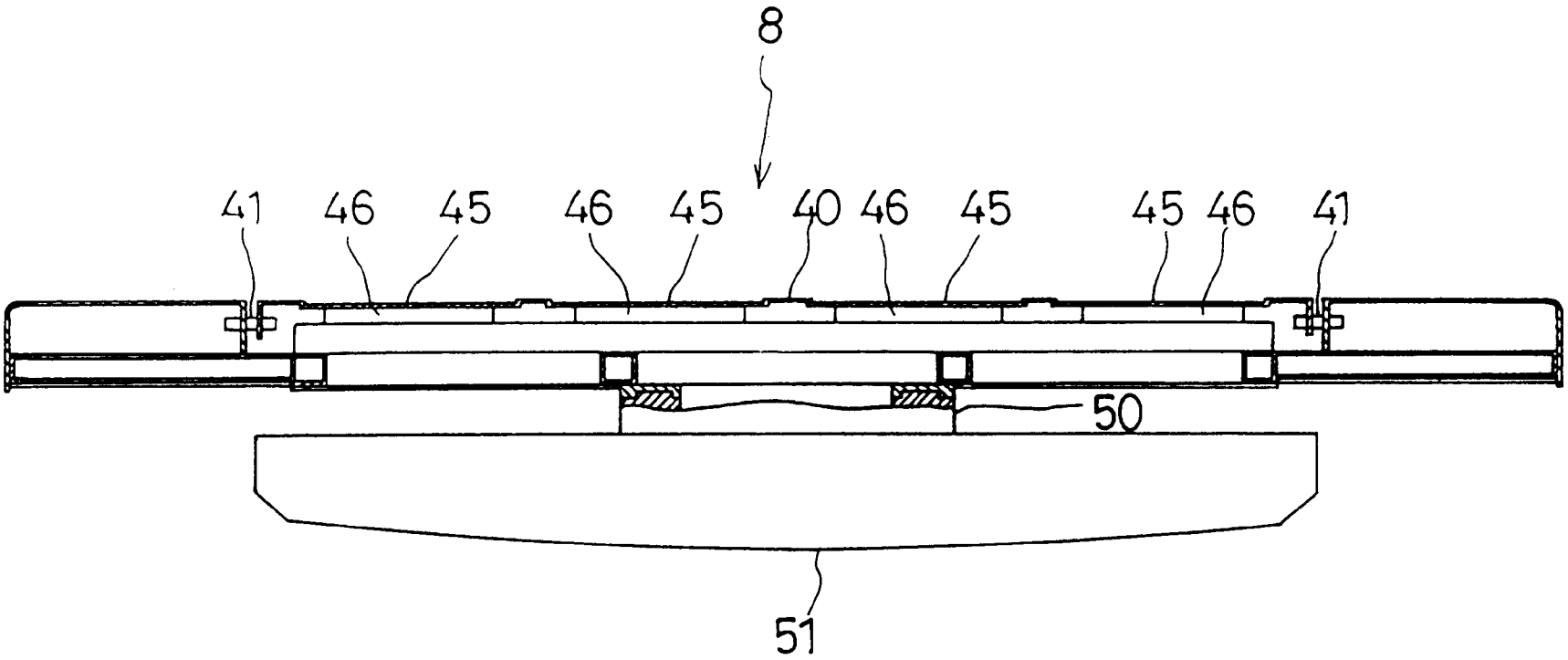
FIG. 7 is a front view showing the board partly in section.

On the upper surface of the long rectangular slanting plate 40 are formed four rectangular step plates in a line. The step plates 45 are somewhat displaced when they are pushed from above and under respective step plates are disposed pressure sensors 46 to detect pushing forces applied to the step plates 45 as shown in FIG. 7.

The step plates 45 are positioned on the axis of the pivots 41. The player P stands turning his back on the revolving arm 7 and putting his both feet on neighboring respective step plates 45, 45.

Therefore, when the player P shifts his weight to any one of his right and left feet, the weight shift can be detected by comparing two detection values of the pressure sensors 46 under the step plates 45. Further, when the player P shifts his weight to the heel or to the toe, the slanting plate 40 slants and the weight shift can be detected by either limit switch 42.

When two players P rides on the board 8 together, the weight shift to either foot can be detected with respect to each player. However, since the slanting plate 40 is common to both players, if the players try to slant the slanting plate 40 to opposite directions, slanting motions are offset with each other and the slanting plate 40 does not slant until the players coincides with each other to slant the slanting plate 40 to the same direction for turning on the limit switch 42.

On a lower surface of the board 8 are attached running racks 51 through a connecting section 50. The running racks 51 extend parallel with each other directed in the lengthwise direction of the board 8 and have lower surfaces formed in gentle arcuate surfaces.

Figure 2:
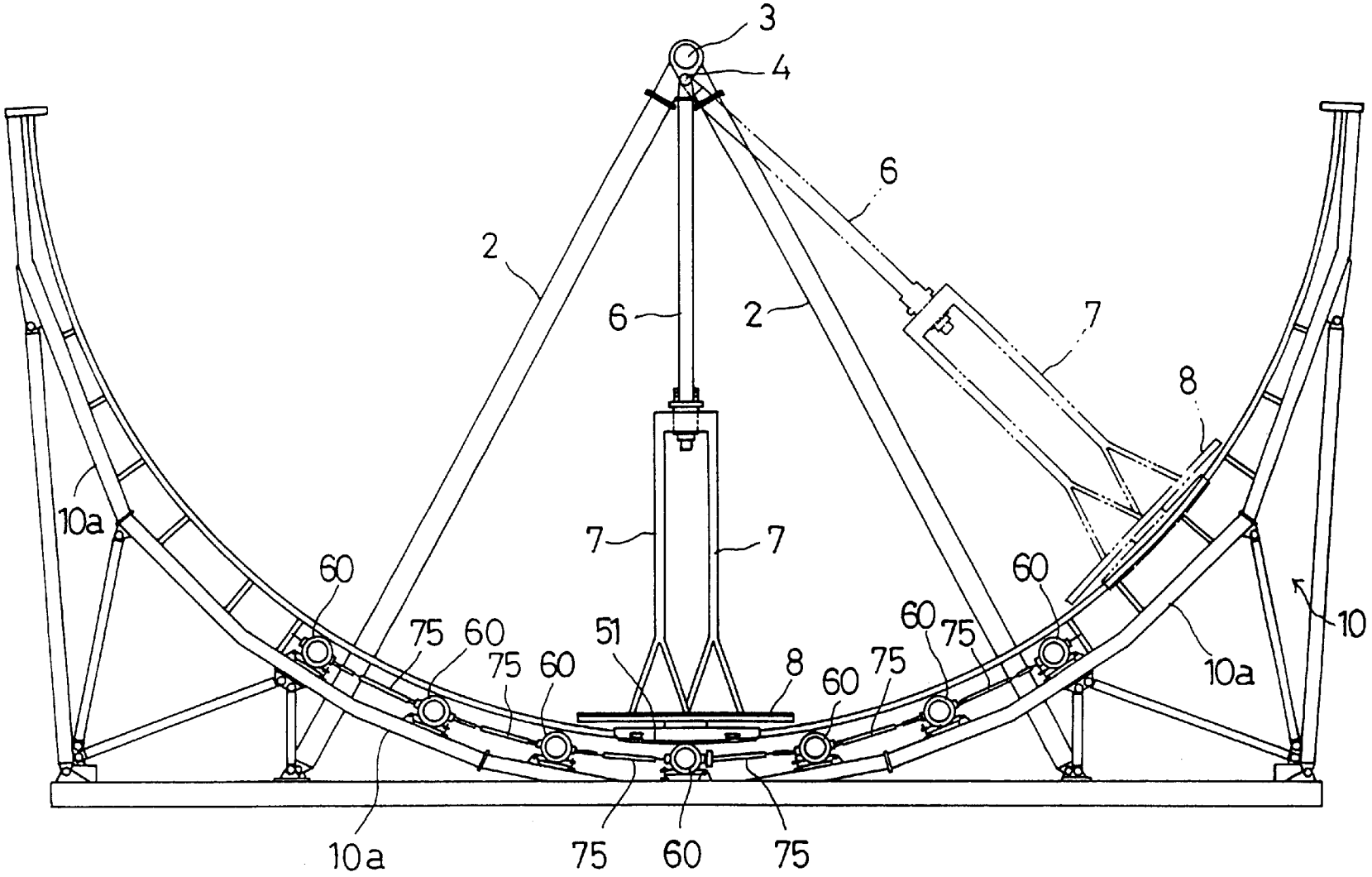
FIG. 2 is a partly omitted front view of the apparatus.

On the one hand, as shown in FIG. 2, on a bottom portion shaped in a half circular arc facing upward of a frame 10*a* assembled in the half-pipe-like frame work 10, seven friction wheels 60 in all are disposed at regular intervals symmetrically with respect to the one disposed at the center. The running rack 51 of the board 8 comes into contact with these friction wheels 60 in order.

Figure 9:
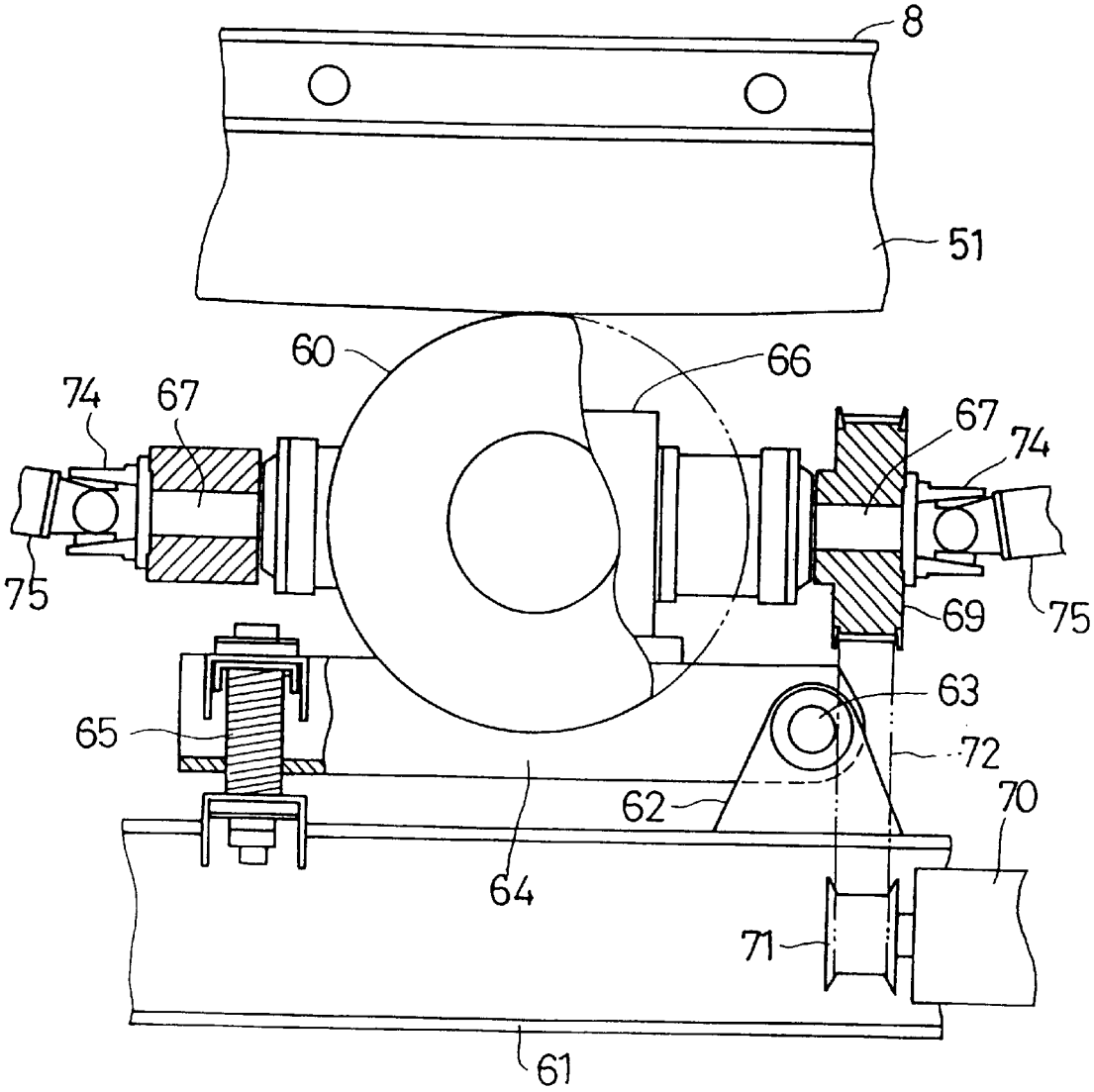
FIG. 9 is a front view showing a rocking drive mechanism partly in section.
Figure 10:
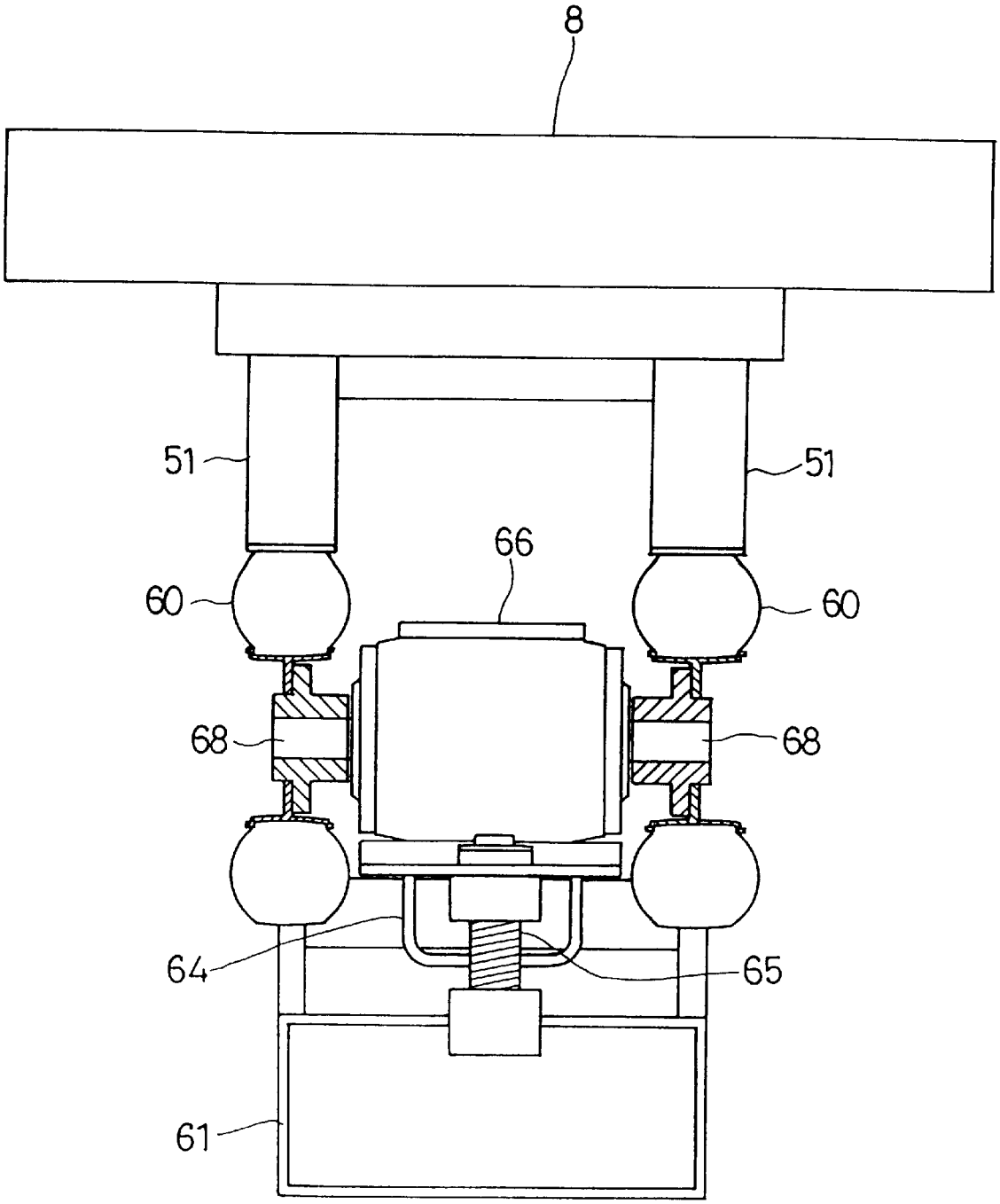
FIG. 10 is a side view of the same.

FIGS. 9 and 10 show the friction wheel 60 at the center and a rocking mechanism neighboring it. On a base 61 are erected a pair of front and rear bearing plates 62 between which a pivot 63 is laid. A rocking frame 64 with an end pivotally supported on the pivot 63 extends horizontally and between another end of the rocking frame 64 and the base 61 is placed a compression spring 65.

A gear box 66 is mounted on the rocking frame 64 which is capable of rocking up and down. The gear box 66 has power transmission shafts 67, 67 projected right and left and output shafts 68, 68 projected front and rear so that power inputted from one of the power transmission shafts 67 is transmitted to the front and rear output shafts 68, 68 through bevel gears engaging with each other to rotate the output shafts and also transmitted to another transmission shaft 67 to rotate it in the same direction at the same speed as the above-mentioned one transmission shaft 67.

The front and rear output shafts 68 have respective friction wheels 60 fitted so as to be rotated.

On one power transmission shaft 67 is fitted a pulley 69 and a transmission belt 72 is wound round the pulley 69 and a pulley 71 fitted on a drive shaft of a rocking servomotor 70 attached to the base 61 so that the above one power transmission shaft 67 is driven by the rocking servomotor 70 to rotate.

Tip ends of the right and rear power transmission shafts 67 are connected to connecting rods 75 through universal joints 74. Each connecting rod 75 is connected to a power transmission shaft 67 of a neighboring gear box 66 through a similar universal joint 74 to transmit the power.

Other gear boxes 66 have the same construction with exception of the pulley 69 which is provided on the central gear box 66 only. Every neighboring gear boxes are connected through a universal joint 74 and a connecting rod 75 to transmit the power.

Therefore, the seven pairs of friction wheels 60 are driven by one rocking servomotor 70 through seven gear boxes 66 connected with each other by the connecting rods 75 to rotate together in the same direction at the same speed. The board 8 with the running rack 51 coming into contact with the friction wheel 60 is rocked by rotation of the friction wheel 60. The friction wheel 60 is pushed against the lower surface of the running rack 51 by the compression spring 65 to ensure the rolling contact.

Figure 11:
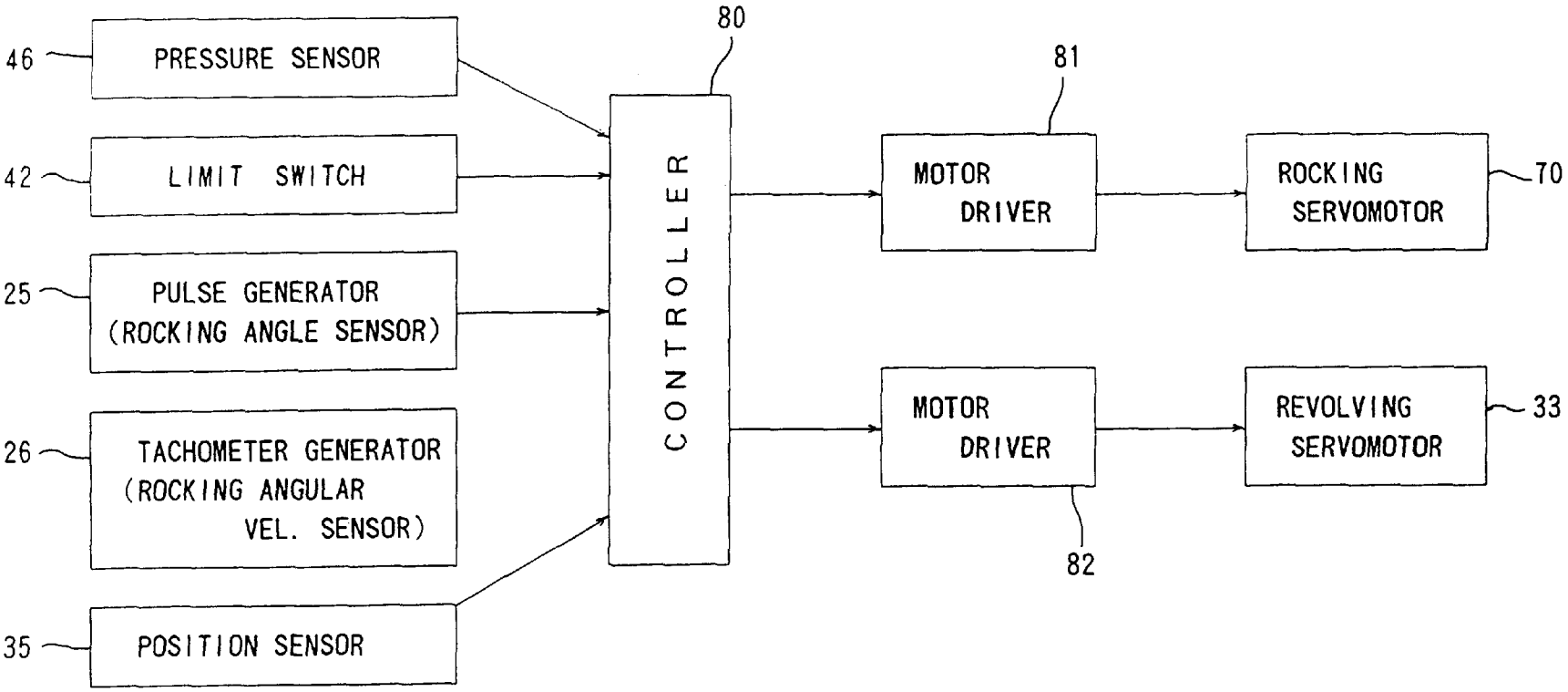
FIG. 11 is a rough block diagram showing a control system of the half-pipe game playing apparatus.

FIG. 11 shows a rough block diagram of a control system of the half-pipe game playing apparatus 1 having the above-mentioned structure.

A computer control by a controller 80 is carried out. Into the controller 80 are inputted operation signals relating to operations by feet of two players P from four pressure sensors 46 and two limit switches 42, a rocking angle detection signal from the pulse generator 25, a rocking angular velocity detection signal from the tachometer generator 26 and a revolving basic point detection signal from the position sensor 35.

The controller 80 processes these inputted signals to output a rocking instruction signal to a motor driver 81 which drives the rocking servomotor 70 in accordance with the instruction. The controller 80 also outputs a revolving instruction signal to a motor driver 82 which drives the revolving servomotor 33 in accordance with the instruction.

Figure 12:
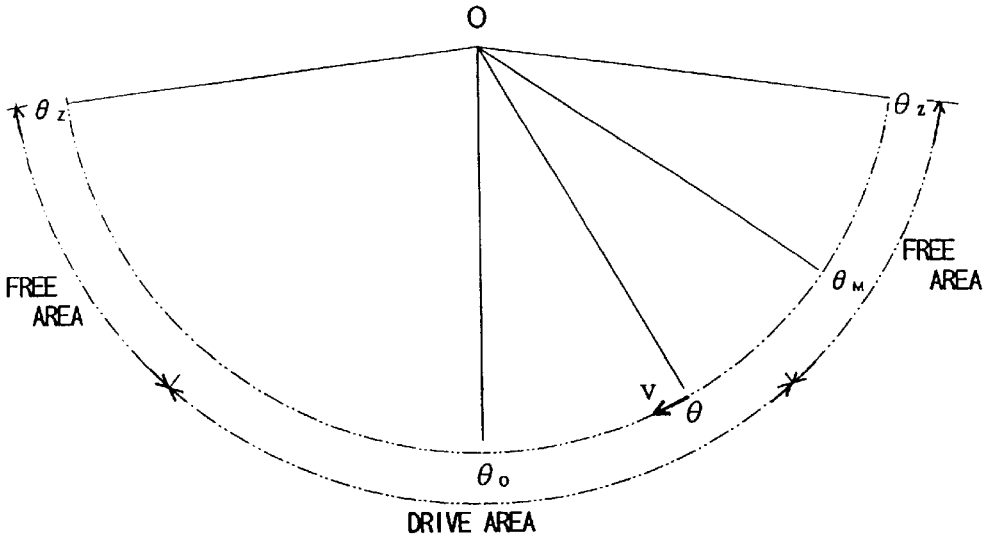
FIG. 12 is a view for illustrating a rocking control method.

At first, rocking control will be described. Referring to FIG. 12, "O" denotes a fulcrum of a pendulum corresponding to the pivotal shaft 4 and a rocking angle θ is measured starting from the lowest point $\theta_0$ of the pendulum. A range on the both sides of the lowest point $\theta_0$ wherein the friction wheels 60 exist is a drive area in which rocking of the board 8 can be controlled. Both outsides of the drive area is free area in which the rocking cannot be controlled and the board 8 carries out a natural pendulum motion.

In case of the natural pendulum motion, when a maximum rocking angle is $\theta_M$, a velocity v at a rocking angle θ is obtained according to the law of conservation of energy as follows.

$$V=\{2gL(\cos\theta-\cos\theta_M)\}^{1/2} \quad (1)$$

Where g is acceleration of gravity and L is length of pendulum.

When the board 8 is to be accelerated, the maximum rocking angle is set to a required value larger than the present maximum rocking angle $\theta_M$ and a velocity v at a rocking angle θ within the drive area is calculated according to the above equation (1). And the rocking servomotor 70 is controlled so that circumferential velocity of the friction wheel 60 becomes v when rocking angle of the board 8 is θ.

It is similar when the board 8 is to be decelerated. In this case, the maximum rocking angle is set to a required value smaller than the present maximum rocking angle $\theta_M$.

Whether the board 8 is to be accelerated or decelerated and an extent of the acceleration, that is the maximum rocking angle of the board 8, are decided by operation of the player P on the board 8.

Weight given to the step plates 45 on which right and left feet of the player P are placed, respectively, are detected by the pressure sensors 46, and when the maximum rocking angle is intended to be made larger, it is necessary that the player shifts his own weight timely to give one of the step plates 45 more weight.

If the player shifts his weight toward advancing direction to give more weight to the step plate 45 of the advancing side when the board 8 begins to return, the board 8 is accelerated and the maximum rocking angle exceeds the preceding value.

The acceleration of the board 8 is large when the board begins to return from the maximum rocking angle and the acceleration is set to be smaller as the rocking angle becomes smaller. Therefore, the extent of the maximum rocking angle is decided by timing of the weight shifting so that a technical skill is required.

A player P having a superior skill can make the maximum rocking angle of the board 8 large to enjoy an exciting play and attract attention of surrounding onlookers.

A basic rocking control when one player P rides on the board 8 has been described above. When two players ride on one board 8, operation timings of weight shifts of the two players are compared and an operation which is more pertinent to make the maximum rocking angle larger is selected for acceleration control.

Namely, the acceleration is carried out based on an operation of a player who shifts the weight toward advancing direction of the board sooner when the board 8 begins to turn from the maximum rocking angle. Therefore, when two players having different skills ride on the same board 8, the rocking control is carried out based on an operation of a player having superior skill so that another player also can experience the same exciting play.

Alternatively, when the two operation timings are different, a mean timing may be led to set the maximum rocking angle based on the mean timing. In this case, when operation timings of the two players on the board are coincide with each other and pertinent, the maximum rocking angle can be made larger.

Regarding the maximum rocking angle, a certain limit rocking angle $\theta_Z$ is set.

Next, the description will made with regard to the revolving control.

Revolving of the board 8 is carried out by that the limit switch 42 detects slanting of the slanting plate 40 due to foot operation of the player and the revolving servomotor 33 is driven in accordance with the detection signal. The revolving of the board 8 is also greatly influenced by the operation timing.

Figure 13:
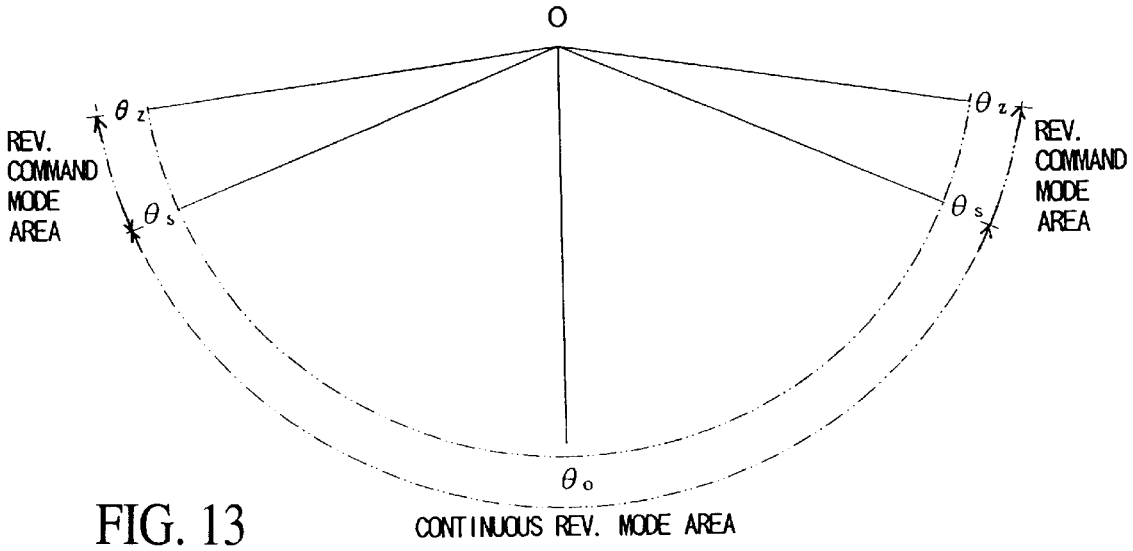
FIG. 13 is a view for illustrating a revolving control method.

Referring to FIG. 13, the control mode differs in accordance with the rocking angle θ of the board 8. Defined boundaries by an rocking angle $\theta_S$ smaller than the limit rocking angle $\theta_Z$ somewhat, a continuous revolving mode area which is a range of the rocking angle smaller than the rocking angle $\theta_S$ and a revolving command mode area which is a range of the rocking angle larger than the rocking angle $\theta_S$ are set.

When the board 8 is in the continuous revolving mode area, the revolving control is carried out in such a manner that the revolution is continued so far as either limit switch 42 is turned on, but maximum velocity of the revolution is decided in accordance with the rocking velocity of the board 8.

Figure 14:
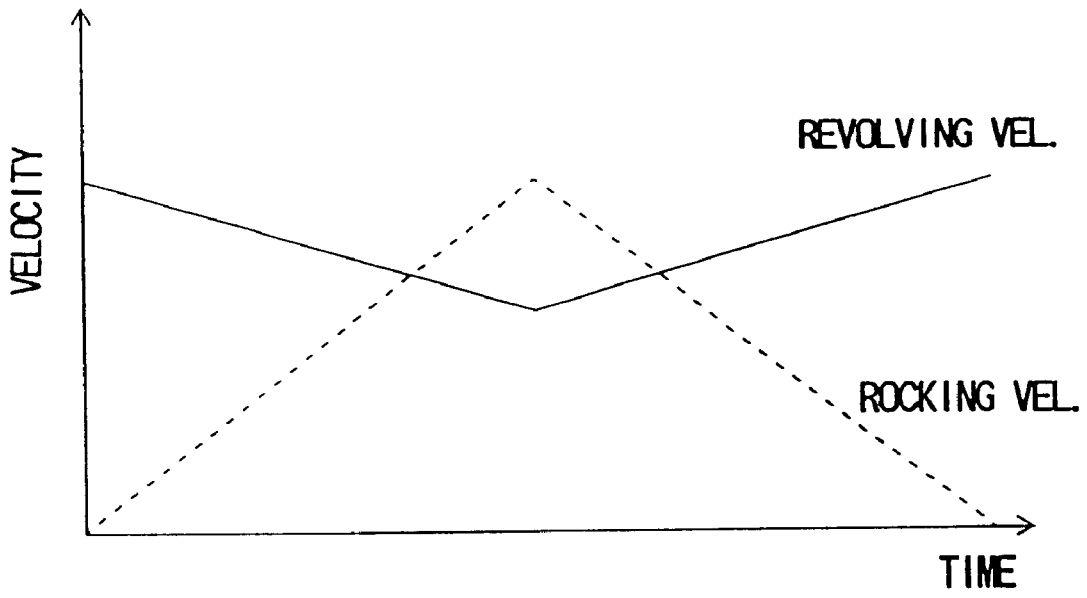
FIG. 14 is a view for illustrating a method for setting revolving speed.

Namely, as shown in FIG. 14, the rocking velocity and the revolving velocity are substantially in inverse proportion to each other. The rocking velocity (dotted line in FIG. 14) is 0 at a maximum rocking angle and increases gradually to a maximum velocity at the lowest point of the board 8, then decreases gradually to 0 at another maximum rocking angle. On the one hand, the revolving velocity (solid line in FIG. 14) changes so that the sum of the both rocking and revolving velocities becomes about constant. That is, the revolving velocity is largest at the maximum rocking angle where the rocking velocity is 0, decreases as the rocking angle becomes small, and is smallest at the lowest point. The foregoing is a revolving control in the continuous revolving mode area.

In the revolving command mode area, if the limit switch 42 is turned on with a good timing, the board 8 is revolved twice at the most and when the limit switch 42 is turned off, revolving of the board 8 is decelerated and stopped with the board 8 directed toward the rocking advancing direction.

Since the revolving command mode area itself is a range wherein the rocking velocity is small and the board 8 is positioned high, the board 8 can be behaved as the board of the actual half-pipe game which is revolved when it jumps out of the half-pipe.

The board 8 has two limit switches 42 either of which is turned on to decide direction of the revolving.

When a single player rides on the board 8, the turning-on operation of the limit switch 42 can be carried out as he likes, however, when two players ride on the board 8, since the both stand on the common slanting plate 40, if the players try to slant the slanting plate 40 to opposite directions, the slanting plate 40 does not slant and any limit switches 42 are not turned on. Only when the players coincide to slant the slanting plate 40 in the same direction, the slanting plate 40 slants and the limit switch 42 detects it.

According to the above-mentioned half-pipe-game plying apparatus, when the player P rides on the board 8 and fasten the safety belt to start the play, for a while, the rocking servomotor is driven in normal and reverse direction regardless of operation of the player P so that rocking angle of the board 8 becomes larger gradually. Therefore, even a quite beginner can enjoy the play. Or, even a person having no experience in the actual skateboard or snow-board can enjoy the play and experience the half-pipe game simulatively.

Figure 15:
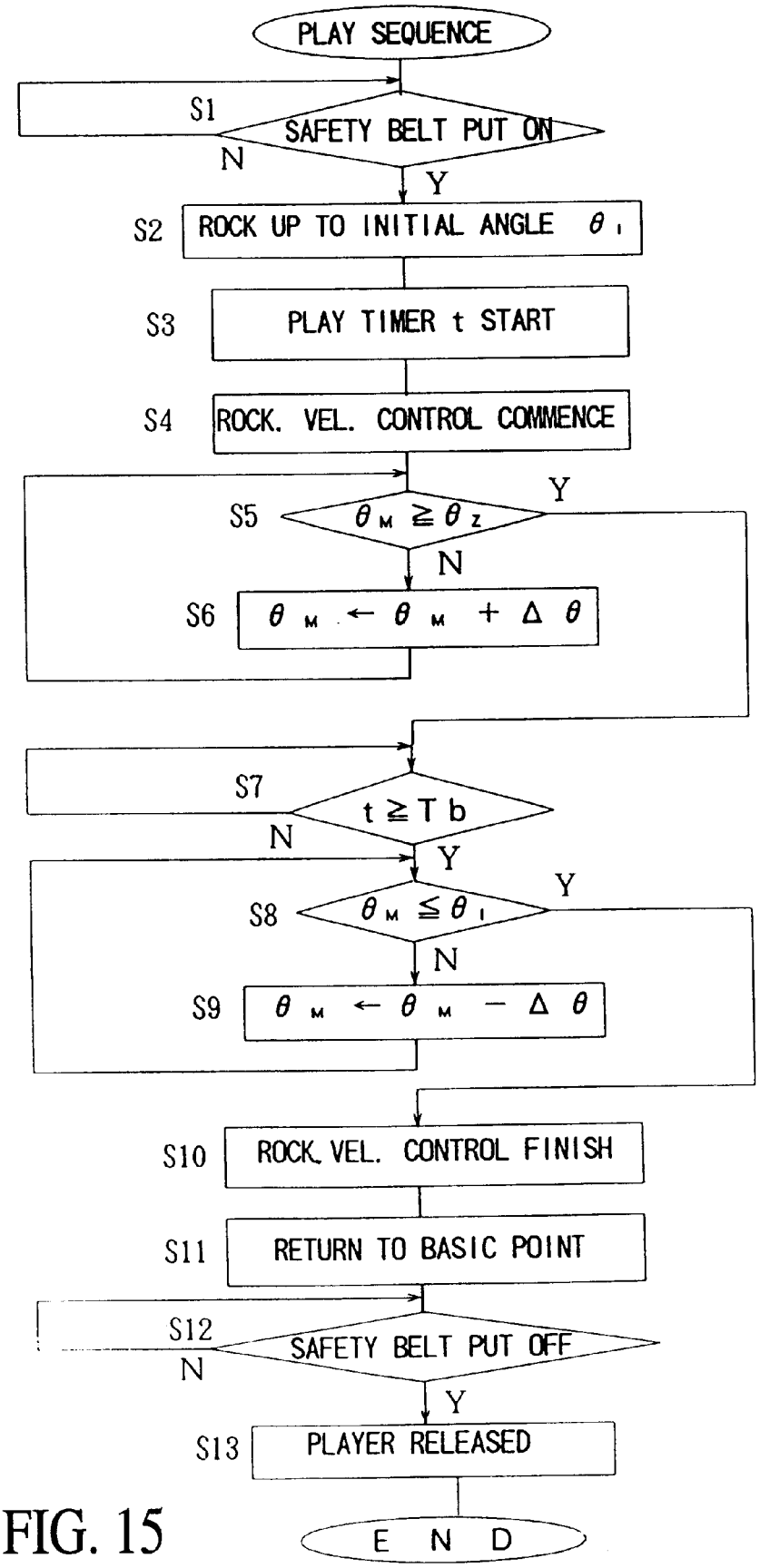
FIG. 15 is a flow chart showing an example of play sequence.
Figure 16:
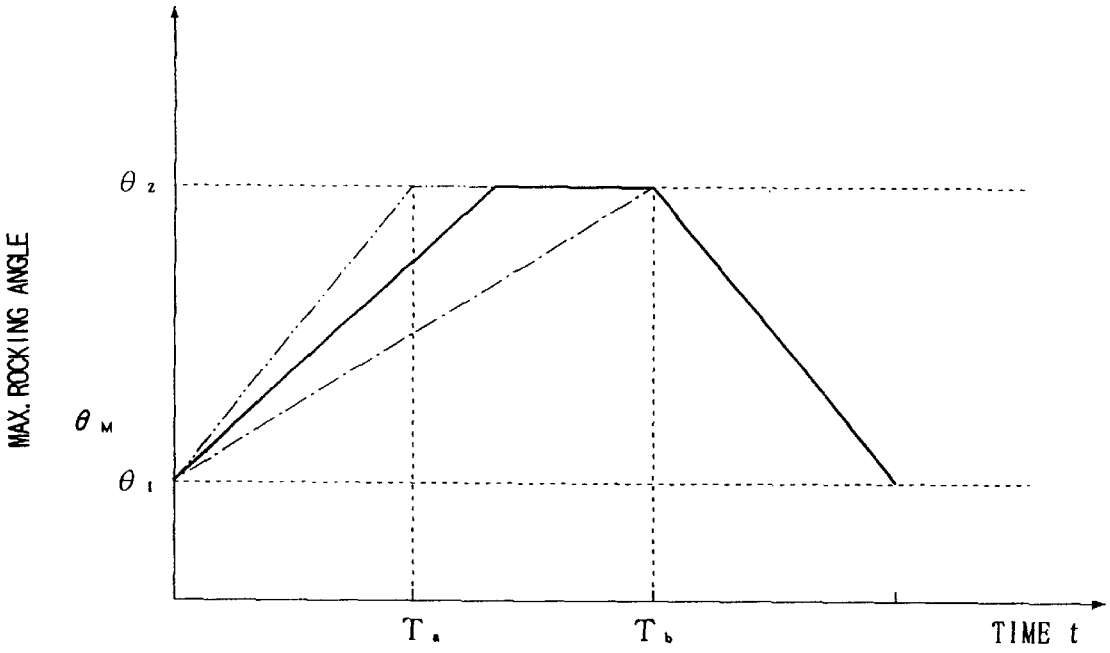
FIG. 16 is a view for illustrating change of rocking of the board by the play sequence.

An example of the play sequence is shown in FIGS. 15 and 16. FIG. 15 is a flow chart of the play sequence and FIG. 16 is a graph showing change of rocking of the board according to the play sequence.

At first, an outline of the change of rocking will be described referring to FIG. 16. After the player rides on the board 8, firstly the board 8 is rocked so that the maximum rocking angle $\theta_M$ reaches an initial angle θ1 regardless of operation of the player P. After that, if the player P operates the step plates 45 with the most suitable timing, the maximum rocking angle reaches the limit rocking angle $\theta_Z$ by a shortest time Ta (two dots-dash line in FIG. 16). However, even if operation timing of the player P is not suit at all or the player does not operate, the maximum rocking angle can reach the limit rocking angle $\theta_Z$ by a longest time Tb (one dot-dash line in FIG. 16).

That is, usually the maximum rocking angle $\theta_M$ changes between the one dot-dash line and the two dots-dash line in FIG. 16 and if the player is an expert having a superior skill, change of the maximum rocking angle approaches the two dots-dash line and the maximum rocking angle reaches the limit rocking angle in a short time. Therefore the expert can stay in the revolving command mode area for longer time to enjoy revolving the board 8.

After the time Tb, the maximum rocking angle $\theta_M$ becomes smaller gradually to the initial angle θ1 and then the board returns to a basic position where the player rode thereon.

According to FIG. 15 which is a flow chart of the above play sequence, at first, the player P rides on the board 8 and fasten the safety belt (Step 1), then the board 8 rocks to the initial angle θ1 (Step 2). Subsequently a play timer is started (Step 3), and rocking velocity control is commenced (Step 4).

Until the maximum rocking angle $\theta_M$ reaches the limit rocking angle $\theta_Z$ (Step 5), Δθ is added to the maximum rocking angle $\theta_M$ to increase the maximum rocking angle $\theta_M$ gradually (Step 6). If operation instruction and operation timing of the player is pertinent, value of Δθ is determined to be large accordingly and the limit rocking angle $\theta_Z$ is reached in a short time.

When the maximum rocking angle $\theta_M$ reaches the limit rocking angle $\theta_Z$ (Step 5), the flow advances from Step 5 to Step 7 and waits till the play timer reaches the time Tb so that the player P can enjoy revolving play in the meantime.

When the play timer reaches the time Tb (Step 7), the flow advances to Step 8. And at Step 9, Δθ is subtracted from the maximum rocking angle $\theta_M$ to reduce the maximum rocking angle $\theta_M$ gradually till the maximum rocking angle $\theta_M$ reaches the initial angle θ1.

When the maximum rocking angle $\theta_M$ reaches the initial angle θ1 (Step 8), the flow advances to Step 10 to finish the rocking velocity control, then the board 8 is returned to the initial basic point (Step 11).

After that, the player P puts off the safety belt (Step 12) to be released (Step 13) and gets out of the board 8 to finish the play.

According to the above play sequence, since even a beginner can rock the board 8 to the limit rocking angle $\theta_Z$ and have about the same experience as an expert, people on wide classes can enjoy the play.

However, the above-mentioned play sequence is only an example, and, alternatively, a play sequence in which the maximum rocking angle $\theta_M$ does not reach the limit rocking angle $\theta_Z$ if the operation is not pertinent is also possible. According to such a play sequence, the expert can enjoy more thrilling and exciting play, on the one hand, the general people can be roused to obtain skills more and more. Further, other various play sequences can be intended.

INDUSTRIAL APPLICABILITY

The present invention can be utilized for a vehicle playing apparatus having a simulated vehicle moving variably along a predetermined orbiting path on which a player rides to operate it himself.

I claim:

1. A vehicle playing apparatus comprising:

a vehicle moving variably on which a player rides;

drive means for driving said vehicle;

detection means for detecting a state of said vehicle;

operation means provided on said vehicle which is operated by said player with a timing selected by said player; and control means for controlling said drive means based on a detection signal inputted from said detection means and an operation signal inputted from said operation means, said control means outputting an instruction signal to sad drive means in accordance with said detection signal, said operation signal and timing of said operation signal in view of said state of said vehicle.

2. A vehicle playing apparatus comprising;

a vehicle moving variably along a predetermined orbiting path on which a player rides;

drive means for driving said vehicle;

detection means for detecting a state of said vehicle;

operation means provided on said vehicle; and control means for controlling said drive means based on a detection signal inputted from said detection means and an operation signal inputted from said operation means, said control means outputting an instruction signal to said drive means in accordance with said detection signal, said operation signal and timing of said operation signal in view of said state of said vehicle, said orbiting path being divided into an orbiting range in which said vehicle is automatically moved and another orbiting range in which said vehicle behaves differently and moves in accordance with an operation of said player.

3. A vehicle playing apparatus as claimed in claim 1 or 2, wherein said control means outputs an instruction signal to said drive means so as to encourage present movement of said vehicle when timing of said operation signal are judged pertinent in view of the state of said vehicle.

4. A vehicle playing apparatus as claimed in claim 1 or 2, wherein said vehicle moves variably along a plurality of orbiting paths, said drive means, detection means and operation means are provided for each of the orbiting paths respectively, and said control means outputs instruction signals for each of the orbiting paths to corresponding drive means.

5. A vehicle playing apparatus as claimed in claim 4, wherein a sum of velocities of variable moves on said plurality of the orbiting paths is always below a predetermined value.

6. A vehicle playing apparatus as claimed in claim 5, wherein said vehicle moves variably along two orbiting paths, a sum of a velocity of variable move on an orbiting path and a velocity of variable move on another orbiting path is constant, and when the velocity on an orbiting path is maximum, the velocity on another orbiting path is minimum.

7. A vehicle playing apparatus as claimed in claim 6, wherein a plurality of operation means are provided for an orbiting path of the vehicle, and said control means decides said instruction signal to be outputted to said drive means based on a plurality of operation signals from said operation means.

8. A vehicle playing apparatus as claimed in claim 7, wherein said control means selects a most pertinent operation signal among said operation signals in view of state of the vehicle for deciding said instruction signal.

9. A vehicle playing apparatus as claimed in claim 7, wherein a mean value of said operation signals is calculated for deciding said instruction signal.

10. A vehicle playing apparatus as claimed in claim 1 or 2, wherein said vehicle is a board hung from a pivotal shaft so as to rock freely moving right and left along a pendulum rocking orbiting path.

11. A vehicle playing apparatus as claimed in claim 10, wherein said drive means comprises a rotary friction wheel coming into contact with an arcuate lower surface of said board to rock said board.

12. A vehicle playing apparatus as claimed in claim 10, wherein operation means to be operated by feet of said player on said board is provided.

13. A vehicle playing apparatus as claimed in claim 12, wherein said operation means comprises a pair of step plates provided on an upper surface of said board for placing respective feet of said player and pressure sensors fitted to said respective step plates for detecting stepping forces of said feet, detection signal of said pressure means being used as said operation signal.

14. A vehicle playing apparatus as claimed in claim 13, wherein said control means outputs an instruction signal to said drive means so as to encourage present rocking of said vehicle when indications and timings of both operation signals from a pair of said step plates are judged pertinent in view of rocking state of said vehicle.

15. A vehicle playing apparatus as claimed in claim 12, wherein said operation means comprises plural pairs of step plates provided on an upper surface of said board on which respective feet of a plurality of players are placed, and pressure sensors fitted to said step plates to detect stepping forces of right and left feet, and a detection signal from said pressure sensors is used as said operation signal.

16. A vehicle playing apparatus as claimed in claim 15, wherein said control means selects an operation signal from signals of a pair of said step plates which is judged that indication and timing are most pertinent in view of rocking state of said vehicle and outputs an instruction signal to said drive means based on said selected signal so as to encourage present rocking of said vehicle.

17. A vehicle playing apparatus as claimed in claim 1 or 2, wherein:

said vehicle is a board hung from a pivotal shaft for rocking, capable of revolving about its own central vertical axis, having a rocking orbiting path directed right and left and a revolving orbiting path round said axis;

rocking drive means, rocking detection means and rocking operation means corresponding to said rocking orbiting path are provided;

revolving drive means, revolving detection means and revolving operation means corresponding to said revolving orbiting path are provided; and said control means outputs respective signals for said orbiting paths to corresponding drive means.

18. A vehicle playing apparatus as claimed in claim 17, wherein:

a slanting plate supporting a pair of step plates is pivoted on an upper surface of said board so as to slant;

said rocking operation means is constituted by said step plates and pressure sensors fitted to said step plates, detection signal of said pressure sensor being used as said rocking operation signal ;

said revolving operation means is constituted by said slanting plate and slanting sensors fitted to said slanting plate, detection signal of said slanting sensor being used as said revolving operation signal.

19. A vehicle playing apparatus as claimed in claim 18, wherein said control means outputs an instruction signal to said rocking drive means so as to encourage present rocking of said board when indication and timing of said rocking operation signal are judged pertinent in view of rocking state of said board, and outputs an instruction signal to said revolving drive means so as to revolve said board when indication and timing of said revolving operation signal is judged pertinent in view of rocking state of said board.

20. A vehicle playing apparatus as claimed in claim 19, wherein said control means judges that timing of said revolving operation signal is more pertinent ant outputs an instruction signal to said revolving drive means so as to revolve said board faster as rocking velocity of said board is smaller.

21. A vehicle playing apparatus as claimed in claim 17, wherein:

a slanting plate supporting pairs of step plates is pivoted on an upper surface of said board so as to slant;

pairs of pressure sensors are fitted to respective said step plates for outputting rocking operation signals as said rocking operation means; and said control means selects an operation signal from said rocking operation signals which is judged that indication and timing are most pertinent in view of rocking state of said board and outputs an instruction signal to said rocking drive means based on said selected signal so as to encourage present rocking of said board.

22. A vehicle playing apparatus comprising;

a vehicle moving variably on which a player rides;

drive means for moving said vehicle;

operation signal output means for outputting an operation signal in response to an operation of said player;

detection means for detecting a state of said vehicle; and control means for automatically controlling said drive means of said vehicle in accordance with a predetermined program when said state of the vehicle, as detected by said detection means, is different from a predetermined state.

23. A vehicle playing apparatus comprising:

a vehicle moving variably on which a player rides;

a drive mechanism for driving said vehicle;

a detection member for detecting a state of said vehicle;

an operation member provided on said vehicle which is operational by said player at a timing selected by said player; and a controller for controlling said drive mechanism based on a detection signal inputted from said detection member and an operation signal inputted from said operation member, said controller outputting an instruction signal to said drive mechanism in accordance with said detection signal, said operation signal and timing of said operation signal in view of said state of vehicle.

24. A vehicle playing apparatus comprising:

a vehicle movable on a predetermined orbiting path, on which a player rides;

a drive mechanism for driving said vehicle so as to move along said orbiting path;

detection equipment for detecting a state of said vehicle on said orbiting path to generate a state signal;

an operation member provided on said vehicle which is operational by said player at a timing selected by said player;

signal generating equipment for generating an operation signal corresponding to the operation of said operation member; and a controller for controlling said drive mechanism based on said state signal inputted from said detection equipment and said operation signal inputted from said operation member, said controller outputting an instruction signal to said drive mechanism in accordance with said state signal, said operation signal and timing of said operation signal in view of said state of said vehicle.

25. A vehicle playing apparatus comprising:

a board on which a player rides hung from a pivotal shaft so as to rock freely;

a board drive mechanism for engaging with said board to rock said board about said pivotal shaft;

detection equipment for detecting a state of rocking of said board so as to generate a state signal;

an operation member provided on said vehicle which is operational by said player at a timing selected by said player;

signal generating equipment for generating an operation signal corresponding to the operation of said operation member; and a controller for controlling said drive mechanism based on said state signal inputted from said detection equipment and said operation signal inputted from said signal generating equipment, said controller outputting an instruction signal to said drive mechanism in accordance with said state signal, said operation signal and timing of said operation signal in view of said state of said vehicle.

* * * * *